US006833114B1

(12) United States Patent
Christen et al.

(10) Patent No.: US 6,833,114 B1
(45) Date of Patent: Dec. 21, 2004

(54) PIPETTE WITH TIP EJECTOR

(75) Inventors: Sylvain Christen, Ecublens (CH); Jean-Pierre Uldry, Ecublens (CH)

(73) Assignee: Socorex Isba S.A., Ecublens (CH)

( * ) Notice: Subject to any disclaimer, the term of this patent is extended or adjusted under 35 U.S.C. 154(b) by 0 days.

(21) Appl. No.: 09/979,323

(22) PCT Filed: May 18, 1999

(86) PCT No.: PCT/CH99/00210

§ 371 (c)(1),
(2), (4) Date: Nov. 16, 2001

(87) PCT Pub. No.: WO00/69562

PCT Pub. Date: Nov. 23, 2000

(51) Int. Cl.[7] ..... B01L 3/02

(52) U.S. Cl. ..... 422/100; 73/864.11; 73/864.14; 73/864.18

(58) Field of Search ..... 422/100; 73/864.11, 73/864.14, 864.18

(56) References Cited

U.S. PATENT DOCUMENTS

| | | | | |
|---|---|---|---|---|
| 4,009,611 A | * | 3/1977 | Koffer et al. | 73/864.14 |
| 4,965,050 A | | 10/1990 | Jessop | |
| 5,320,810 A | * | 6/1994 | Al-Mahareeq et al. | 422/100 |
| 2002/0001545 A1 | * | 1/2002 | Cronenberg et al. | 422/100 |
| 2003/0099578 A1 | * | 5/2003 | Cote et al. | 422/100 |
| 2003/0156994 A1 | * | 8/2003 | Mahler et al. | 422/100 |
| 2004/0028564 A1 | * | 2/2004 | Viot | 422/100 |

FOREIGN PATENT DOCUMENTS

| | | |
|---|---|---|
| DE | 19708151 A | 9/1998 |
| FR | 2287941 A | 5/1976 |
| GB | 2249172 A | 4/1992 |
| WO | WO 9637302 A | 11/1996 |

* cited by examiner

*Primary Examiner*—Jan M. Ludlow
(74) *Attorney, Agent, or Firm*—Clifford W. Browning; Woodard, Emhardt, Moriarty, McNett & Henry LLP

(57) ABSTRACT

The invention relates to a pipette for transferring liquids, comprising the following: at least one piston-cylinder arrangement (3, 4), in which the cylinder (4) is arranged in such a way that it can be provided with a replaceable tip (8) for containing the liquid to be transferred; a piston actuating device (5) for drawing up and discharging the liquid; and a tip ejector device (6). Said ejector device comprises an ejection mechanism (16, 16') which can be displaced along the cylinder in order to eject a tip (8) from the end of said 24 cylinder. A device (17) for actuating the ejection mechanism is also provided. The invention is characterized in that the ejector device (6) comprises a device for adjusting position (24, 24', 33, 33', 39, 39'), which is arranged in such a way that it is possible to modify the limit position reached by an ejection end (22, 22') of the ejector device at the end of a stroke.

13 Claims, 4 Drawing Sheets

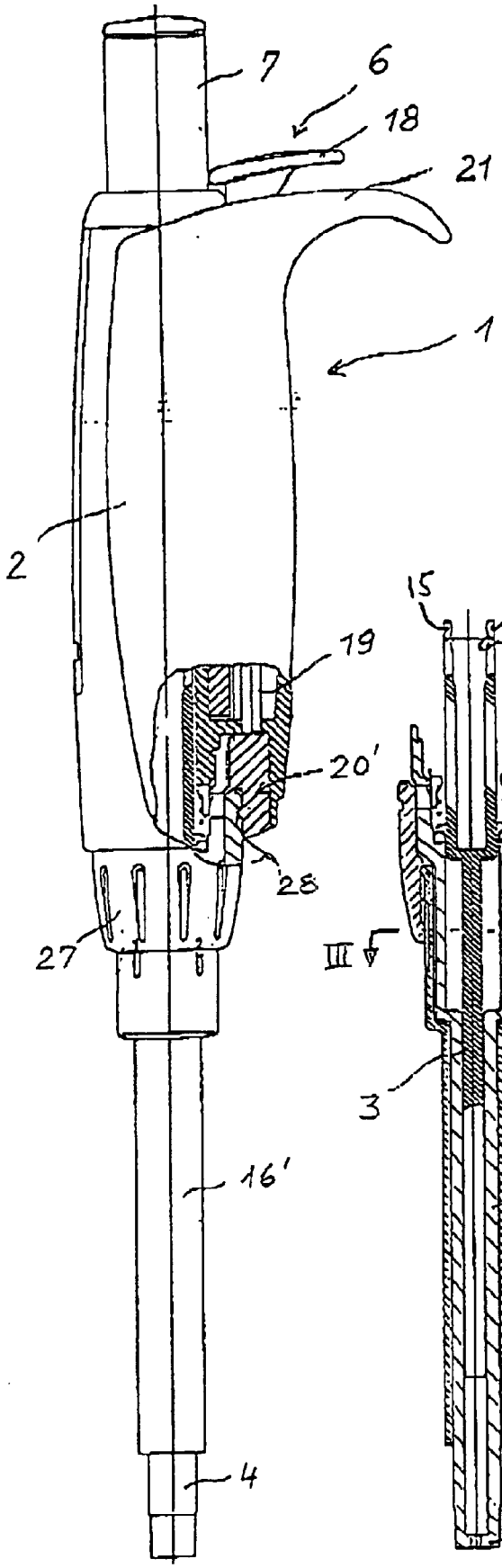
FIG 1
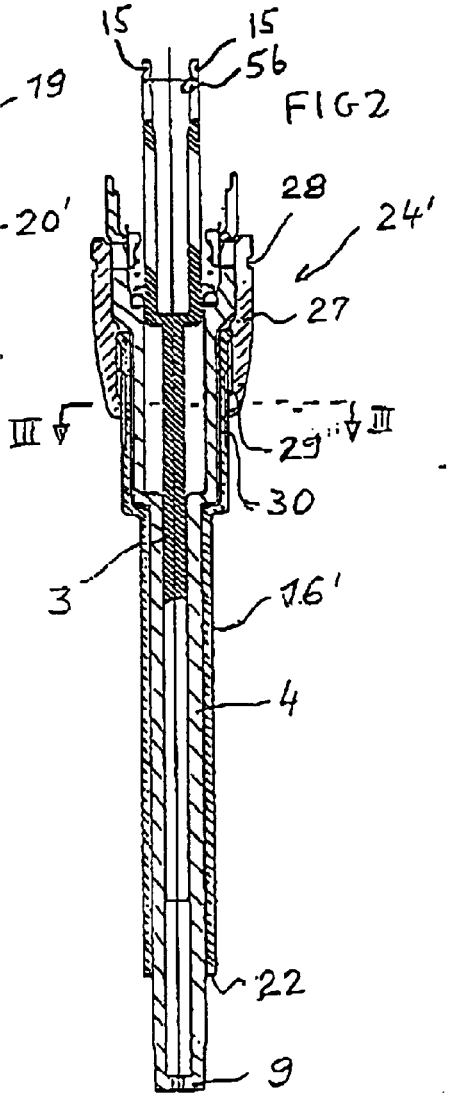
FIG2
FIG3
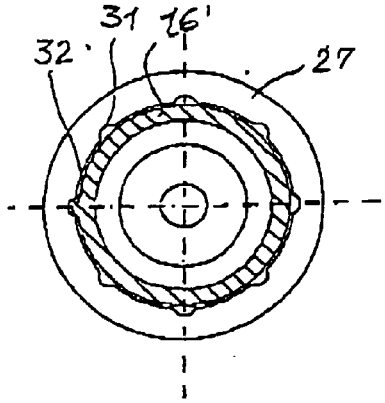

11
26
25
13
18
24
7
21
6
1'
19
12
5
17
5b
14
15
15
2
20
3
16
23
22
4
8
9
10

PIPETTE WITH TIP EJECTOR

The invention concerns a pipette for transferring liquids which comprises at least one piston-cylinder arrangement arranged so that it can be provided with a transfer tip.

Pipettes of this type are generally known, an example being described in the U.S. Pat. No. 5,614,153. Such a pipette allows small quantities of a liquid to be transferred in a replaceable tip mounted to the free end of the pipette cylinder. This transfer occurs without pipette contamination, since the used tips are replaced by new tips. The pipette is equipped with a tip ejector that can be actuated manually and comprises an ejection mechanism sliding along the cylinder until it hits the tip and pushes it so that it will separate from the cylinder. In this pipette the ejection mechanism has an invariable stroke length, and its final position is fixed.

The tips that are used can come from different manufacturers or have different shapes, so that their dimensions can vary. Thus, the position of the tips on the cylinder can differ depending on the variants available on the market and on the force of fixation. This leads to differences in the position of the edge of the tip hit by the ejection mechanism. Since the differences in position are of the same order of magnitude as the stroke of the ejection mechanism, certain tips will not be ejected or may encounter the ejector before forming a close fit between the tip and the pipette cylinder.

It is one objective of the invention to realise a pipette that allows tips to be attached and ejected in a reliable manner, particularly while allowing for the variable position of the tip edge relative to the pipette. Such a pipette is preferably designed so that it is robust and easy to use.

The present liquid transfer pipette comprises at least one piston-cylinder arrangement in which the cylinder can be provided with a replaceable tip, a piston actuating device that induces the drawing up and discharging of the liquid, and a tip ejector device that comprises an ejection mechanism that can be displaced along the cylinder, its particular feature being that the ejector device comprises a device for position adjustment so arranged that the end position attained during a tip ejection operation by the end of the ejection mechanism at the end of a stroke can be modified. It should be noted that in practice, the adjustment will generally be made by adjusting the starting position of the free edge of the ejection mechanism that is intended to hit the upper edge of the tip. All embodiments of the present pipette allow tips of different shapes and dimensions to be attached and ejected in a reliable manner.

The position adjustment device may comprise a sleeve arranged on the cylinder of the piston-cylinder arrangement which cooperates with the ejection mechanism so as to allow the end position of the extremity of the ejection mechanism to be adjusted relative to the cylinder. The sleeve and the ejection mechanism can be coupled by threaded segments or by a catch or other element resting on a crown with sloping surface, in such a way that the position of the ejection mechanism is adjusted by a relative rotation between the sleeve and this mechanism. Thus, in a first embodiment the ejection mechanism can be rotated while the sleeve is held fixed, but in an alternative embodiment the sleeve can be rotated while the ejection mechanism is fixed. The sleeve and/or the ejection mechanism can be provided with notches, with a catch or similar elements defining their angular positions relative to the counterpart. Advantageously, the sleeve that can be mounted on a segment of the cylinder, and the ejection mechanism are readily accessible and adjustable.

In modifications of the position adjustment device a sleeve is used, for instance, the position of which can be adjusted relative to the ejection mechanism and which is mounted on this mechanism in such a way that it forms the ejecting extremity of this mechanism. The sleeve and the ejection mechanism can have corresponding threaded segments or comprise other means of attachment which allow the position of the sleeve to be adjusted as a function of the tip being used.

In another modification a position adjustment device is used where the end position of the ejection mechanism can be modified by a variation of the stroke of the ejection mechanism relative to the cylinder. The ejection mechanism can for instance be coupled to its actuating device via an organ of variable length so that at least an end position of the actuating mechanism can be modified.

Other aspects, objectives and advantages of the invention will become apparent from the following description, accompanying drawings, and the claims.

Embodiments of the invention are described below by way of example while referring to the drawings in which FIG. 1 is a partial sectional view of a first embodiment of a pipette according to the invention;

FIG. 2 is a partial sectional view of a piston-cylinder arrangement of the pipette of FIG. 1;

FIG. 3 is a magnified sectional view along the line III—III of FIG. 2;

Figure 4:
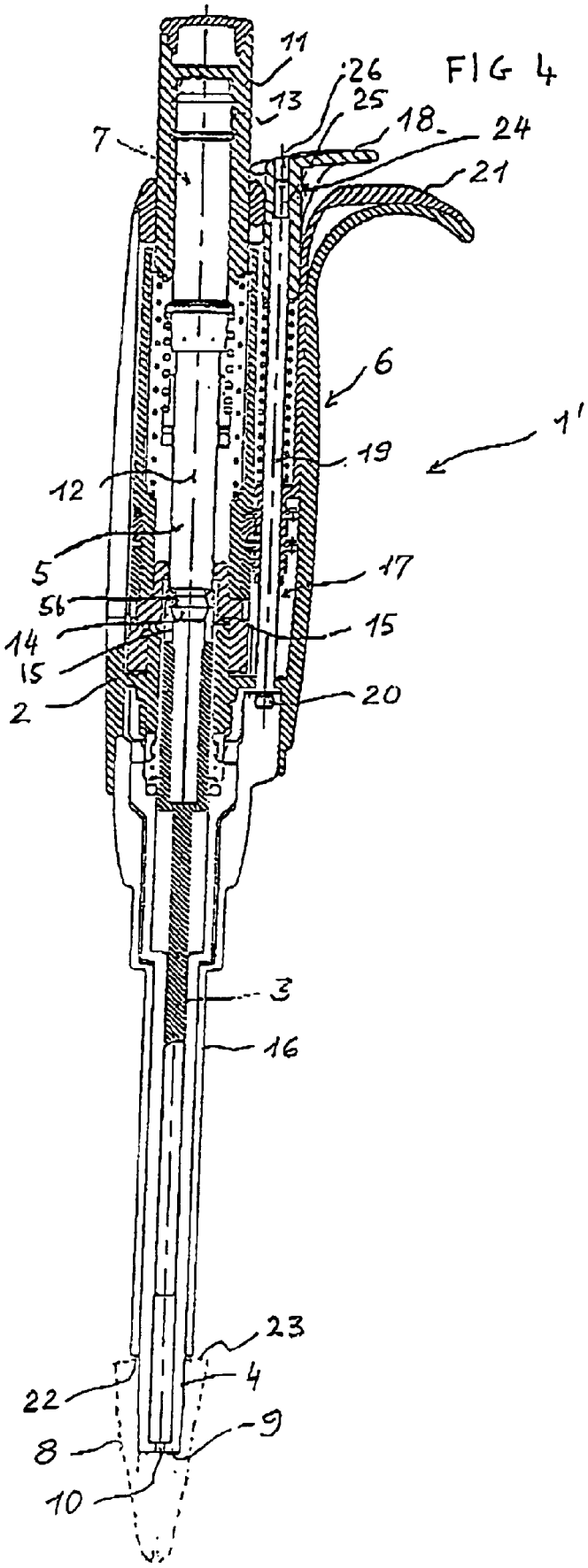
FIG. 4 is a sectional view of a second embodiment of a pipette according to the invention.

FIGS. 1 to 3 and FIG. 4 show pipettes 1 and 1', respectively, in which analogous parts have been designated by the same reference numerals. Such a pipette comprises a pipette body 2 provided with a habitual piston-cylinder arrangement 3, 4, a piston actuating device 5, and an ejector device 6. The piston actuating device 5 comprises a push-button 7 acting on piston 3 of the piston-cylinder arrangement so that liquid can be drawn up and/or discharged via a replaceable tip 8 mounted at the extremity 9 of cylinder 4 of the piston-cylinder arrangement. Cylinder 4 communicates with the tip 8 through an opening 10 in its end 9.

The push-button 7 of the piston actuating device 5 comprises a button 11 and a rod 12. Rod 12 is joined to button 11 by a threaded segment 13 in such a way that for definition of the liquid volume being drawn up, the position of rod 12 and hence of piston 3 can be adjusted relative to the cylinder. Other piston actuating devices 12 can be provided without departing from the scope of the invention, so that the actuation can for instance be hydraulic or electric.

At its end 14, rod 12 is joined to the piston 3 in such a way that it can be separated from it. Piston 3 is provided with elastic arms 15 having recesses 56 in their inner surfaces so that they can cooperate with the end 14 of rod 12 that is ball-shaped. Thus, the elastic arms 15 and the end 14 can be rapidly disconnected by applying a certain pull relative to body 2 on the piston-cylinder arrangement. In this way one can for instance swap piston-cylinder arrangements having different suction volumes or different shapes and dimensions so as to be in harmony with different standards, or exchange defective arrangements without a need for replacing the entire appliance. The connection between the elastic arms 15 and the ball 14 constitutes an advantageous pin-plug arrangement, since the devices can be disconnected and reconnected in a very simple and rapid manner.

The ejector device 6 comprises an ejection mechanism 16 or 16' having a tubular segment arranged so that it can slide on cylinder 4, as well as an actuating device 17 for this ejection mechanism. The actuating device 17 comprises a push-button 18 and a rod 19 linking the push-button to a coupling mechanism 20 or 20'. The coupling mechanism realises a severable snap joint between the ejection mechanism 16 or 16' and the actuating device 17, for instance by interaction between projections and grooves formed on complementary parts. By pushing the push-button 18 all the way down to the position in which it will for instance come to strike the flange or a segment 21 of the pipette body 2, the ejection mechanism 16 or 16' is displaced by a distance determined by the displacement of this push-button. The extremity 22 of the ejection mechanism comes to hit the upper edge 23 of the tip so as to separate it from cylinder 4. The push-button 18 is advantageously placed on the same side of the pipette body as the grip 21, so as to facilitate actuation of the ejecting push-button that is readily accessible to the operator. On the other hand, this arrangement leaves the other side of the pipette body free for easy fitting of a display device.

In the embodiment shown in FIG. 4, the ejector device comprises a position adjustment device 24 having a threaded segment 25 at the upper end of rod 19 that is engaged in a complementary threaded segment of a bore 26 in the push-button 18. The top part of the threaded segment 25 is accessible from outside so that the position of rod 19 can be adjusted relative to the push-button 18, since the coupling mechanism 20 allows the rod 19 to be rotated. This rotation will displace the ejection mechanism 16 relative to cylinder 4. The position of extremity 22 of the ejection mechanism 16 can thus be adjusted so that tips 8 having upper edges situated at different heights relative to the extremity 9 of the cylinder can be ejected.

In a variant the position of push-button 18 is adjusted so as to vary the stroke of the actuating mechanism that is determined by the distance between the upper limiting position of the push-button and the flange or grip 21. The change in stroke of the push-button 18 will thus also modify the end position attained by extremity 22 of the ejection mechanism when the ejector is actuated. One thus attains a reliable ejection of tips having different positions and/or dimensions.

FIGS. 1 to 3 show a preferred embodiment of the invention. In this example, the position adjustment device 24' comprises a sleeve 27 mounted around cylinder 4 close to its upper end. Sleeve 27 has a peripheral groove 28 receiving a projecting part of the coupling mechanism 20' connected with the actuating rod 19. In one embodiment the sleeve 27 can be rotated around its axis while in the axial direction it remains solidly attached to the actuating device of the ejection mechanism 16'. An inner thread 29 of sleeve 27 cooperates with a thread 30 on the upper part of the ejection mechanism 16' so that by rotating the sleeve one can bring the extremity 22 of the ejection mechanism closer to the extremity 9 of cylinder 4 or take it further away from it. The inner surface of the sleeve has a series of axial slots 31 into which a bump 32 in the periphery of the upper part of mechanism 16' can enter so as to define the angular position of the sleeve relative to that mechanism. The mechanism 16' is prevented from being rotated about its axis and hence shifts in the axial direction relative to cylinder 4 when its position is adjusted by rotating the sleeve 27. In another embodiment sleeve 27 is fixed while the mechanism 16' is rotatably attached, so that a rotation of the ejection mechanism will bring the extremity 22 closer to the extremity 9 of cylinder 4 or take it further away from it.

Figure 5:
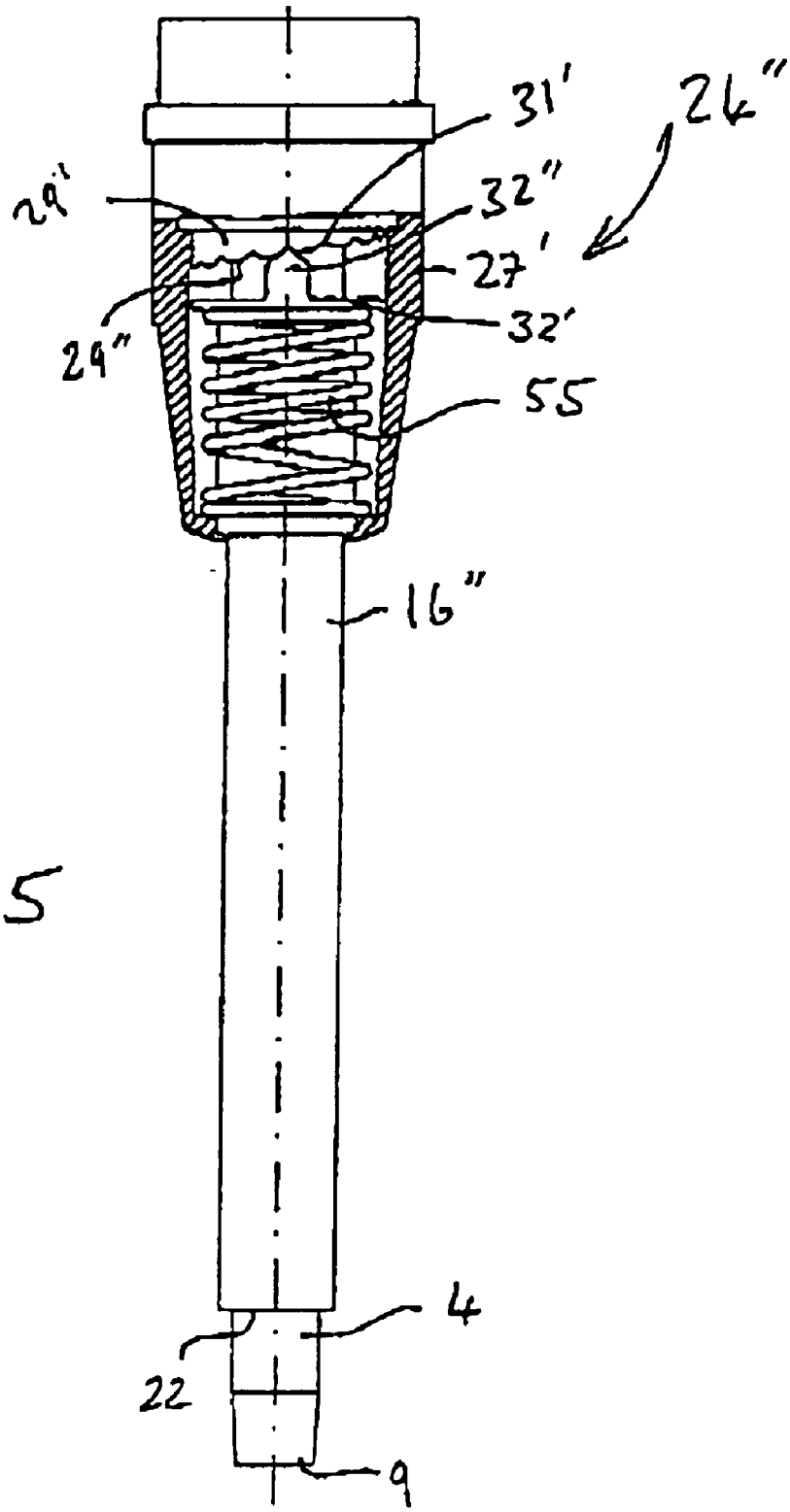
FIG. 5 is a partial sectional view of a piston-cylinder arrangement of a third embodiment.
Figure 9:
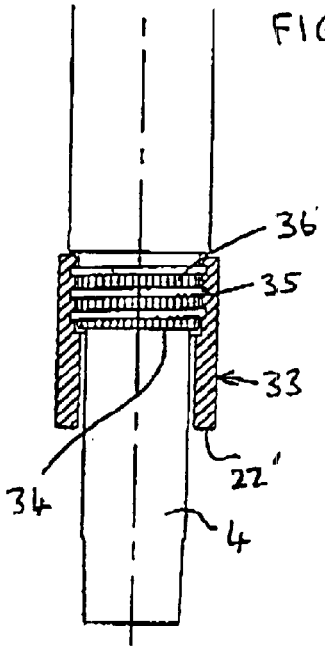
FIGS. 6 to 9 are partial sectional views of variants of a position adjustment device located close to the extremity of the pipette cylinder.

According to the embodiment of FIG. 5, the ejector device comprises a position adjustment device 24" provided with a fixed sleeve 27' and an ejection mechanism 16" mounted so as to enable its rotation about cylinder 4. The ejection mechanism is provided with a piece 32 having a catch 32" that engages in notches 31' of a crown 29' that has an annular inclined engaging surface 29". The notches 31' arranged at intervals on the periphery of the crown thus define positions of different heights for adjusting the position of extremity 22 of the ejection mechanism 16". A spring 55 acting on the sleeve 27' and on the mechanism 16" ensures the engagement of catch 32" in one of the notches 31'. The piston-cylinder arrangement of FIG. 5 can also comprise a piston and organs allowing fast coupling to a pipette body which are similar to the organs described above when referring to the embodiment of FIG. 2.

Other embodiments of the position adjustment device can be realised without departing from the scope of the invention. An adjustment sleeve may in particular be mounted on a terminal part of the ejection mechanism according to the variants shown in FIGS. 6 to 9 so as to form an ejecting edge 22' the position of which can be adjusted relative to pipette cylinder 4.

Figure 6:
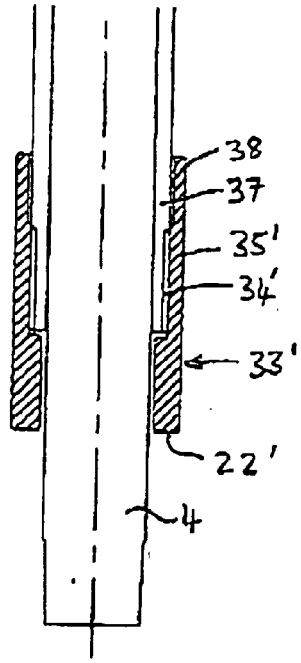

In the variants of FIGS. 6 to 9 a sleeve 33 or 33' is mounted on segment 34 or 34' of the ejection mechanism which has a thread 35 or 35' cooperating with a complementary thread of the sleeve. According to FIG. 9, cogging grooves 36 are formed in the thread base in order to enable good definition of the angular position of sleeve 33. In the variant of FIG. 6 the notches are shifted to the cylindrical portion 37 of the ejection mechanism and are formed by a set of goffers 38 on this portion and on the sleeve 33'.

Figure 7:
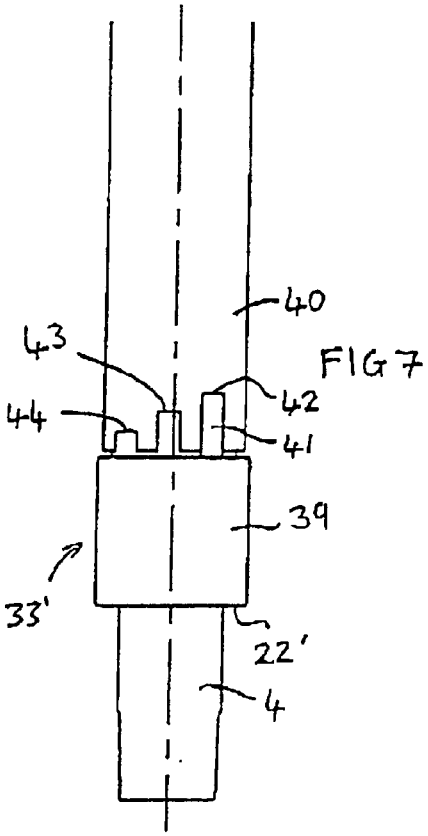

FIG. 7 shows a variant according to which a sleeve 39 is mounted on a terminal segment 40 of the ejection mechanism via catches such as those shown at 41 which are set in corresponding grooves worked in the periphery of segment 40. These grooves, like those shown at 42, 43, 44, have different heights so that corresponding positions of the sleeve relative to the ejection mechanism can be defined. Guidance of the sleeve is secured by cylinder 4 on which it slides.

Figure 8:
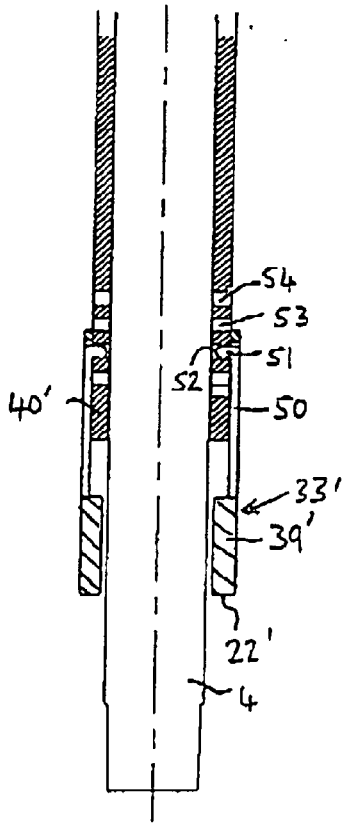

In the variant of FIG. 8 a sleeve 39' is provided with longitudinal tongues 50 having projections 51 on their free ends which are arranged so that they will be able to engage into openings such as those shown at 52, 53, 54 which are located at different heights in the portion 40' of the ejection mechanism.

Thus, in the embodiments of FIGS. 6 to 9 the end position of the extremity of the ejection mechanism can be adjusted at this extremity so that an efficient ejection can be secured for tips having their upper edge at different heights relative to the pipette cylinder.

What is claimed is:

1. Pipette for the transfer of liquids with at least one piston-cylinder arrangement (3, 4) in which the cylinder (4) is arranged so that it can be fitted with a replaceable tip (8) intended to contain the liquid to be transferred, a piston actuating device (5) for drawing up and discharging liquid, a tip ejector device (6) where the ejector device comprises an ejection mechanism (16, 16') having an ejection extremity (22, 22') that can be displaced along the cylinder from an initial position to an end position in order to eject a tip (8) from an extremity of the cylinder, and an actuating device (17) for the ejection mechanism, wherein the ejector device (6) comprises a position adjustment device (24, 24', 24", 33, 33', 39, 39') arranged so as to allow modification of the end position of said ejection extremity (22, 22') while a replaceable tip is fitted on the cylinder.

2. Pipette according to claim 1, wherein the position adjustment device (24, 24', 24") comprises a sleeve (27, 27',

33, 33', 39, 39') mounted so as to allow a relative displacement between a portion of the ejection mechanism and said sleeve.

3. Pipette according to claim 1, characterized in that the position adjustment device (24, 24') is arranged so that it allows the position of the ejection mechanism (16, 16') or of a part (33, 33', 39, 39') solidly attached to this mechanism to be modified relative to the pipette cylinder (4).

4. Pipette for the transfer of liquids with at least one piston-cylinder arrangement (3, 4) in which the cylinder (4) is arranged so that it can be fitted with a replaceable tip (8) intended to contain the liquid to be transferred, a piston actuating device (5) for drawing up and discharging liquid, a tip ejector device (6) where the ejector device comprises an election mechanism (16, 16') having an ejection extremity (22, 22') that can be displaced alone the cylinder from an initial position to an end position in order to eject a tip (8) from an extremity of the cylinder, and an actuating device (17) for the election mechanism, wherein the ejector device (6) comprises a position adjustment device (24, 24', 24", 33, 33', 39, 39') arranged so as to allow modification of the end of said ejection extremity (22, 22'), the position adjustment device (24, 24', 24") comprising a sleeve (27, 27', 33, 33', 39, 39') mounted so as to allow a relative displacement between a portion of the election mechanism and said sleeve, the sleeve (27, 33, 33') and the ejection mechanism comprising complementary threaded segments (29, 30; 35, 35') which cooperate in order to allow said relative displacement to be realized.

5. Pipette for the transfer of liquids with at least one piston-cylinder arrangement (3, 4) in which the cylinder (4) is arranged so that it can be fitted with a replaceable tip (8) intended to contain the liquid to be transferred, a piston actuating device (5) for drawing up and discharging liquid, a tip elector device (6) where the ejector device comprises an ejection mechanism (16, 16') having an ejection extremity (22, 22') that can be displaced along the cylinder from an initial position to an end position in order to elect a tip (8) from an extremity of the cylinder, and an actuating device (17) for the election mechanism, wherein the ejector device (6) comprises a position adjustment device (24, 24', 24", 33, 33', 39, 39') arranged so as to allow modification of the end position of said ejection extremity (22, 22'), the position adjustment device (24, 24', 24") comprising a sleeve (27, 27', 33, 33', 39, 39') mounted so as to allow a relative displacement between a portion of the election mechanism and said sleeve, the position adjustment device (24") comprising at least one catch (32") arranged on the ejection mechanism or on a fixed counterpart fixed in relation to the cylinder, which engages in notches (31') arranged on an annular inclined surface (29") of the fixed counterpart or ejection mechanism, respectively.

6. Pipette according to claim 5, wherein the position adjustment device comprises a spring (55) pressing on the ejection mechanism (16") in order to secure engagement of the catch (32") in one of the notches (31').

7. Pipette for the transfer of liquids with at least one piston-cylinder arrangement (3, 4) in which the cylinder (4) is arranged so that it can be fitted with a replaceable tip (8) intended to contain the liquid to be transferred, a piston actuating device (5) for drawing up and discharging liquid, a tin ejector device (6) where the elector device comprises an ejection mechanism (16, 16') having an ejection extremity (22, 22') that can be displaced along the cylinder from an initial position to an end position in order to eject a tip (8) from an extremity of the cylinder, and an actuating device (17) for the ejection mechanism, wherein the ejector device (6) comprises a position adjustment device (24, 24', 24", 33, 33', 39, 39') arranged so as to allow modification of the end position of said election extremity (22, 22'), the position adjustment device (24, 24', 24") comprising a sleeve (27, 27', 33, 33', 39, 39') mounted so as to allow a relative displacement between a portion of the election mechanism and said sleeve, the sleeve (27, 27', 33, 33') and the ejection mechanism comprise comprising a fixture (31, 32; 31', 32"; 36, 38) which allows the relative angular positions of is the ejection mechanism and the sleeve to be d fixed.

8. Pipette for the transfer of liquids with at least one piston-cylinder arrangement (3, 4) in which the cylinder (4) is arranged so that it can be fitted with a replaceable tip (8) intended to contain the liquid to be transferred, a piston actuating device (5) for drawing up and discharging liquid, a tip ejector device (6) where the ejector device comprises an ejection mechanism (16, 16') having an ejection extremity (22, 22') that can be displaced along the cylinder from an initial position to an end position in order to eject a tip (8) from an extremity of the cylinder, and an actuating device (17) for the ejection mechanism, wherein the ejector device (6) comprises a position adjustment device (24, 24', 24", 33, 33', 39, 39') arranged so as to allow modification of the end position by said ejection extremity (22, 22'), the position adjustment device (24, 24', 24") comprising a sleeve (27, 27', 33, 33', 39, 39') mounted so as to allow a relative displacement between a portion of the ejection mechanism and said sleeve, the sleeve (27) is being arranged close to an extremity (28) of the cylinder (4) but far from the extremity (9) on which the tip (8) is placed.

9. Pipette according claim 4, 5, 7 or 8, wherein the position adjustment device (24') comprises a fixture (20, 20') enabling a severable connection between an ejection actuating rod (19) of the actuating device (17) and the ejection mechanism (16, 16').

10. Pipette for the transfer of liquids with at least one piston-cylinder arrangement (3, 4) in which the cylinder (4) is arranged so that it can be fitted with a replaceable tip (8) intended to contain the liquid to be transferred, a piston actuating device (5) for drawing up and discharging liquid, a tip ejector device (6) where the ejector device comprises an ejection mechanism (16, 16') having an ejection extremity (22, 22') that can be displaced over a displacement stroke along the cylinder from an initial position to an end position in order to eject a tip (8) from an extremity of the cylinder, and an actuating device (17) for the ejection mechanism, wherein the elector device (6) comprises a position adjustment device (24, 24', 24", 33, 33', 39, 39') arranged so as to allow modification of the end position of said ejection extremity (22, 22'), the position adjustment device (24) is being arranged so that it allows the displacement stroke of the ejection mechanism (16) to be modified relative to the pipette cylinder (4).

11. Pipette according to claim 10, wherein the position adjustment device (24) comprises an actuating rod (19) and a push-button organ (18) coupled so that they allow the position of is the actuating rod to be modified relative to said push-button organ.

12. Pipette according to claim 4 or 10, wherein the piston actuating device (5) comprises a piston actuating push button (7) and a pipette body (2) with a grip (21) in its upper portion close to the piston actuating push-button (7), wherein the ejector device (6) further comprises a an ejection mechanism push-button (18) placed on the same side of the pipette body as the grip (21), and positioned close to said grip.

13. Pipette according to claim 4 or 10, wherein the actuating device (17) of the ejection mechanism is attached in a separable manner by snapping fixtures to the ejection mechanism (16, 16').

* * * * *